US008777464B2

(12) United States Patent
Lin et al.

(10) Patent No.: US 8,777,464 B2
(45) Date of Patent: Jul. 15, 2014

(54) ROTATABLE ILLUMINATION DEVICE

(71) Applicant: Dongguan Masstop Liquid Crystal Display Co., Ltd., Dongguan (CN)

(72) Inventors: Chien-Ku Lin, Taichung (TW); Zhi-Ting Ye, Miaoli County (TW); Chin-Liang Chen, Taichung (TW); Ming-Chuan Lin, Taichung (TW); Ju-Fen Yang, Suzhou (CN)

(73) Assignees: Dongguan Masstop Liquid Crystal Display Co., Ltd., Dongcheng District, Dongguan, Guangdong Province (CN); Wintek Corporation, Tanzi Dist., Taichung (TW)

( * ) Notice: Subject to any disclaimer, the term of this patent is extended or adjusted under 35 U.S.C. 154(b) by 135 days.

(21) Appl. No.: 13/655,423

(22) Filed: Oct. 18, 2012

(65) Prior Publication Data

US 2013/0100684 A1 Apr. 25, 2013

(30) Foreign Application Priority Data

Oct. 21, 2011 (CN) ..... 2011 2 0405451 U
Feb. 17, 2012 (CN) ..... 2012 2 0054113 U

(51) Int. Cl.

| | |
|---|---|
| ***F21V 21/00*** | (2006.01) |
| ***F21V 19/02*** | (2006.01) |
| ***F21V 17/02*** | (2006.01) |
| *F21Y 101/02* | (2006.01) |
| *F21Y 105/00* | (2006.01) |

(52) U.S. Cl.

CPC ..... *F21V 19/02* (2013.01); *F21Y 2101/02* (2013.01); *F21Y 2105/001* (2013.01); *F21V 17/02* (2013.01)

USPC ..... 362/382; 362/249.02; 362/277

(58) Field of Classification Search

CPC ..... F21V 17/02; F21V 19/02; F21V 21/30; F21V 21/14; F21V 21/26; F21V 21/28; F21Y 2101/02; F21Y 2105/001

USPC ..... 362/249.02, 277, 285, 382

See application file for complete search history.

(56) References Cited

U.S. PATENT DOCUMENTS

| | | | | |
|---|---|---|---|---|
| 8,226,278 | B2 * | 7/2012 | Ward et al. | 362/365 |
| 8,657,460 | B2 * | 2/2014 | Bhardwaj et al. | 362/183 |
| 2002/0105808 | A1 * | 8/2002 | Ting Yup | 362/281 |
| 2012/0287653 | A1 * | 11/2012 | Chen et al. | 362/430 |
| 2013/0083547 | A1 * | 4/2013 | Lui | 362/382 |

* cited by examiner

*Primary Examiner* — Stephen F Husar
*Assistant Examiner* — James Cranson, Jr.
(74) *Attorney, Agent, or Firm* — Winston Hsu; Scott Margo

(57) ABSTRACT

A rotatable illumination device includes a first casing, a light emitting module, a first fixing member and a second fixing member. The first casing has a first rotating portion and a first protruding portion is formed on the first rotating portion. The light emitting module is disposed in the first casing. A first indentation is formed on the first fixing member and the first protruding portion can pass through the first indentation. A second indentation and a second protruding portion are formed on the second fixing member and the first protruding portion can pass through the second indentation. The first and second fixing members are fixed together, and the first and second protruding portions are coplanar. The first protruding portion cooperates with the second protruding portion to limit rotating angle of the first casing.

17 Claims, 16 Drawing Sheets

ROTATABLE ILLUMINATION DEVICE

BACKGROUND OF THE INVENTION

1. Field of the Invention

The invention relates to an illumination device and, more particularly, to a rotatable illumination device.

2. Description of the Prior Art

So far illumination devices equipped with light bulbs can be divided into two types including direct light type and side light type. In side light type illumination device, a conventional E27 bulb or a light emitting diode bulb has to be equipped with a reflective cover for guiding light. However, the light emitting efficiency of the conventional side light type illumination device is about 50% to 70% since the reflective cover causes light loss. Therefore, the light emitting side of the light bulb in some side light type illumination devices is directed to a specific direction so as to increase the light emitting efficiency. However, after installing the illumination device on a lamp holder, the light emitting side of the light bulb usually cannot be kept in the correct direction so that the light emitting efficiency is reduced. Thus, how to rotate the illumination device to an appropriate light emitting angle after installing the illumination device on the lamp holder becomes a significant design issue.

SUMMARY OF THE INVENTION

An objective of the invention is to provide a rotatable illumination device so as to solve the aforesaid problems.

According to one embodiment of the invention, a rotatable illumination device comprises a first casing, a light emitting module, a first fixing member and a second fixing member. The first casing has a first rotating portion and a first protruding portion is formed on the first rotating portion. The light emitting module is disposed in the first casing. A first indentation is formed on the first fixing member. The first protruding portion is capable of passing through the first indentation such that the first fixing member is capable of being disposed on the first rotating portion. A second indentation and a second protruding portion are formed on the second fixing member. The first protruding portion is capable of passing through the second indentation such that the second fixing member is capable of being disposed on the first rotating portion. After disposing the first and second fixing members on the first rotating portion sequentially, the first and second fixing members are fixed together, and the first and second protruding portions are coplanar. When the first casing rotates with respect to the first and second fixing members, the first protruding portion cooperates with the second protruding portion to limit rotating angle of the first casing.

In this embodiment, the rotatable illumination device may further comprise a cover and a first lamp socket. The cover is disposed on the first and second fixing members and fixed together with the first and second fixing members. The first lamp socket is fixed on the cover.

As mentioned in the above, when the rotatable illumination device is installed on a lamp holder through the first lamp socket, the first casing can rotate with respect to the first and second fixing members so as to rotate the light emitting side of the light emitting module to an appropriate light emitting angle. Furthermore, when the first casing rotates with respect to the first and second fixing members, the first protruding portion can cooperate with the second protruding portion to limit rotating angle of the first casing so as to prevent electric wires disposed in the first casing from getting damage due to over-rotation of the first casing.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
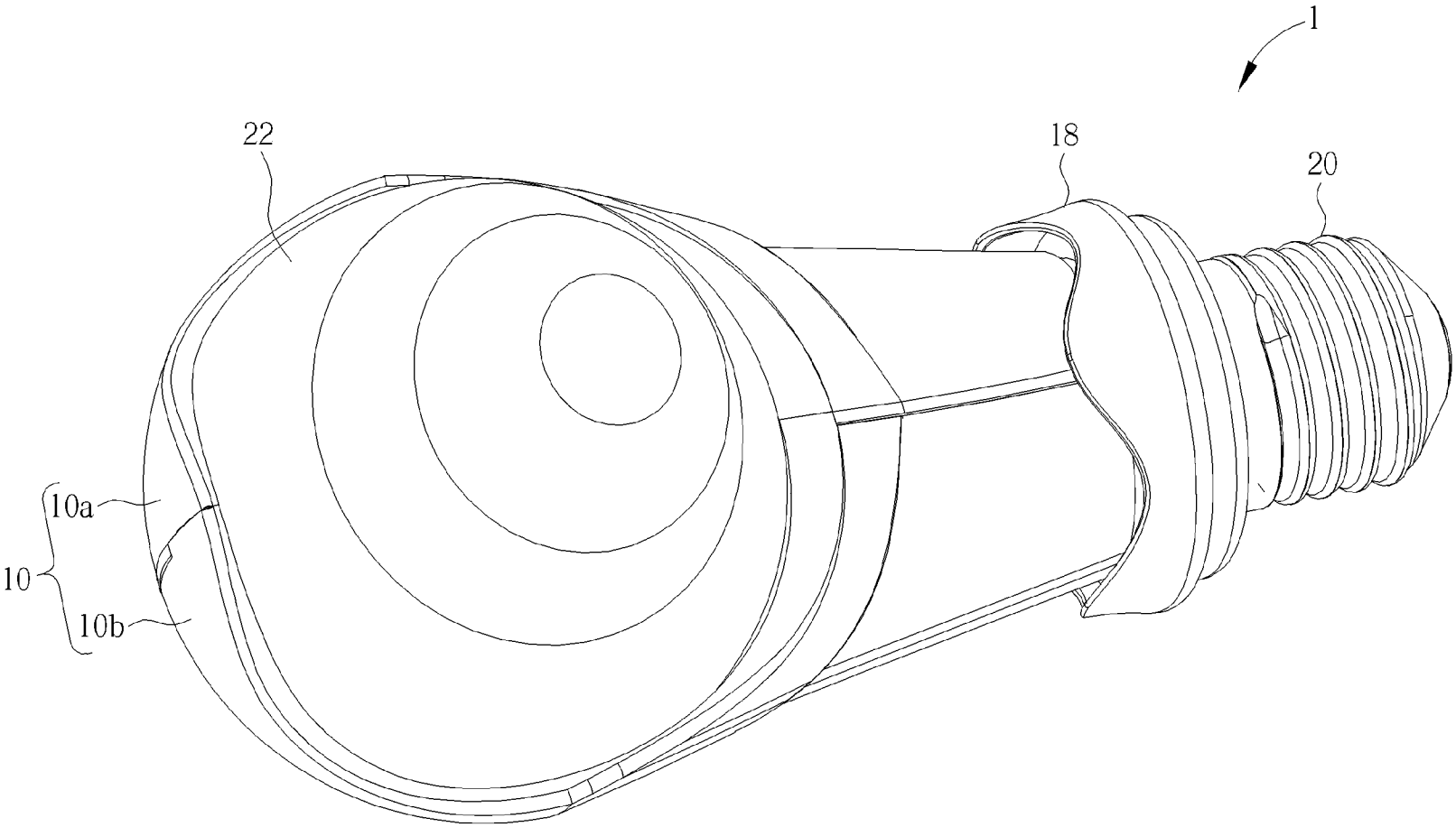
FIG. 1 is a perspective view illustrating a rotatable illumination device according to one embodiment of the invention.
Figure 2:
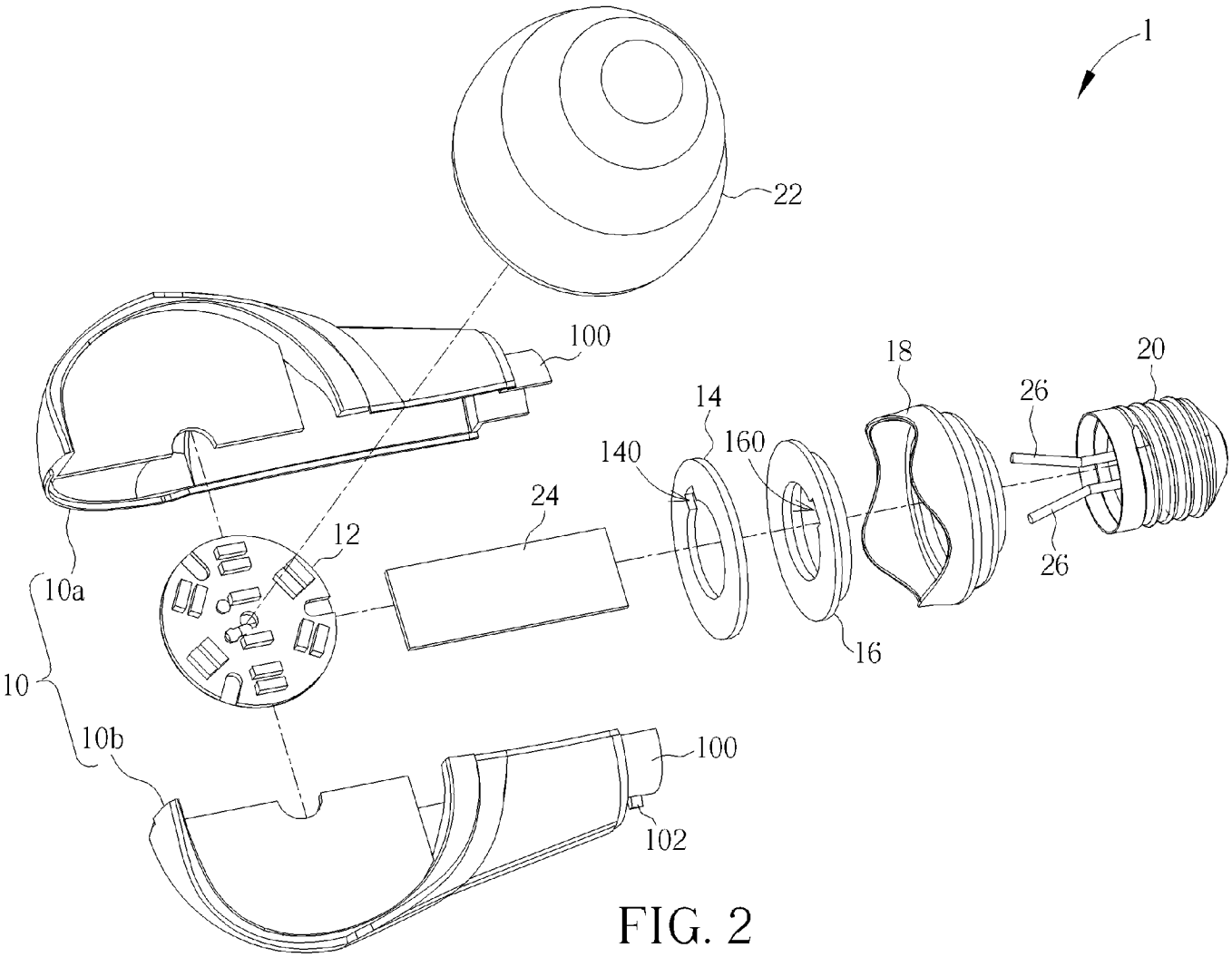
FIG. 2 is an exploded view illustrating the rotatable illumination device shown in FIG. 1.
Figure 3:
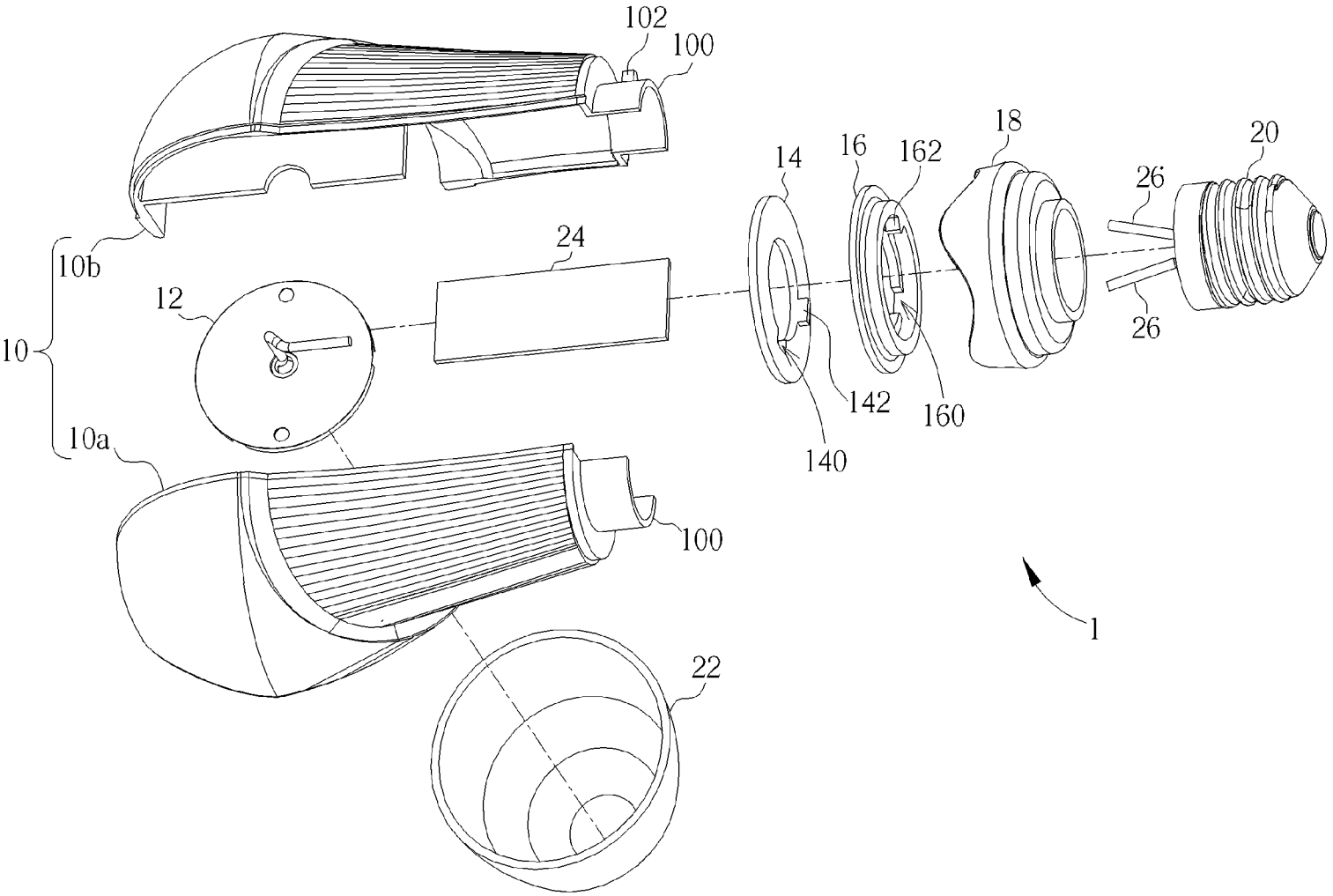
FIG. 3 is an exploded view illustrating the rotatable illumination device shown in FIG. 1 from another viewing angle.

Referring to FIGS. 1 to 3, FIG. 1 is a perspective view illustrating a rotatable illumination device 1 according to one embodiment of the invention, FIG. 2 is an exploded view illustrating the rotatable illumination device 1 shown in FIG. 1, and FIG. 3 is an exploded view illustrating the rotatable illumination device 1 shown in FIG. 1 from another viewing angle. As shown in FIGS. 1 to 3, the rotatable illumination device 1 comprises a first casing 10, a light emitting module 12, a first fixing member 14, a second fixing member 16, a cover 18, a first lamp socket 20, a lamp lens 22, a driving circuit board 24 and two electric wires 26.

In this embodiment, the first casing 10 essentially consists of, but not limited to, two half first casings 10*a*, 10*b* for manufacture and assembly purposes. The light emitting module 12, the driving circuit board 24 and the electric wires 26 are disposed in the first casing 10, wherein the driving circuit board 24 is electrically connected to the light emitting module 12 and the electric wires 26. The driving circuit board 24 is used for driving the light emitting module 12 to emit light. The lamp lens 22 is disposed on the first casing 10 and covers the light emitting module 12. In this embodiment, the light emitting module 12 may comprises a plurality of light emitting diodes or other light sources.

The first casing has a first rotating portion 100 and a first protruding portion 102 is formed on the first rotating portion 100. A first indentation 140 and a third protruding portion 142 are formed on the first fixing member 14 and the third protruding portion 142 is corresponding to the first protruding portion 102. The first protruding portion 102 is capable of passing through the first indentation 140 such that the first fixing member 14 is capable of being disposed on the first rotating portion 100. A second indentation 160 and a second protruding portion 162 are formed on the second fixing member 16. The first protruding portion 102 and the third protruding portion 142 are capable of passing through the second indentation 160 such that the second fixing member 16 is capable of being disposed on the first rotating portion 100. The cover 18 is disposed on the first fixing member 14 and the second fixing member 16 and is fixed together with the first fixing member 14 and the second fixing member 16. The first lamp socket 20 is fixed on the cover 18.

Figure 4:
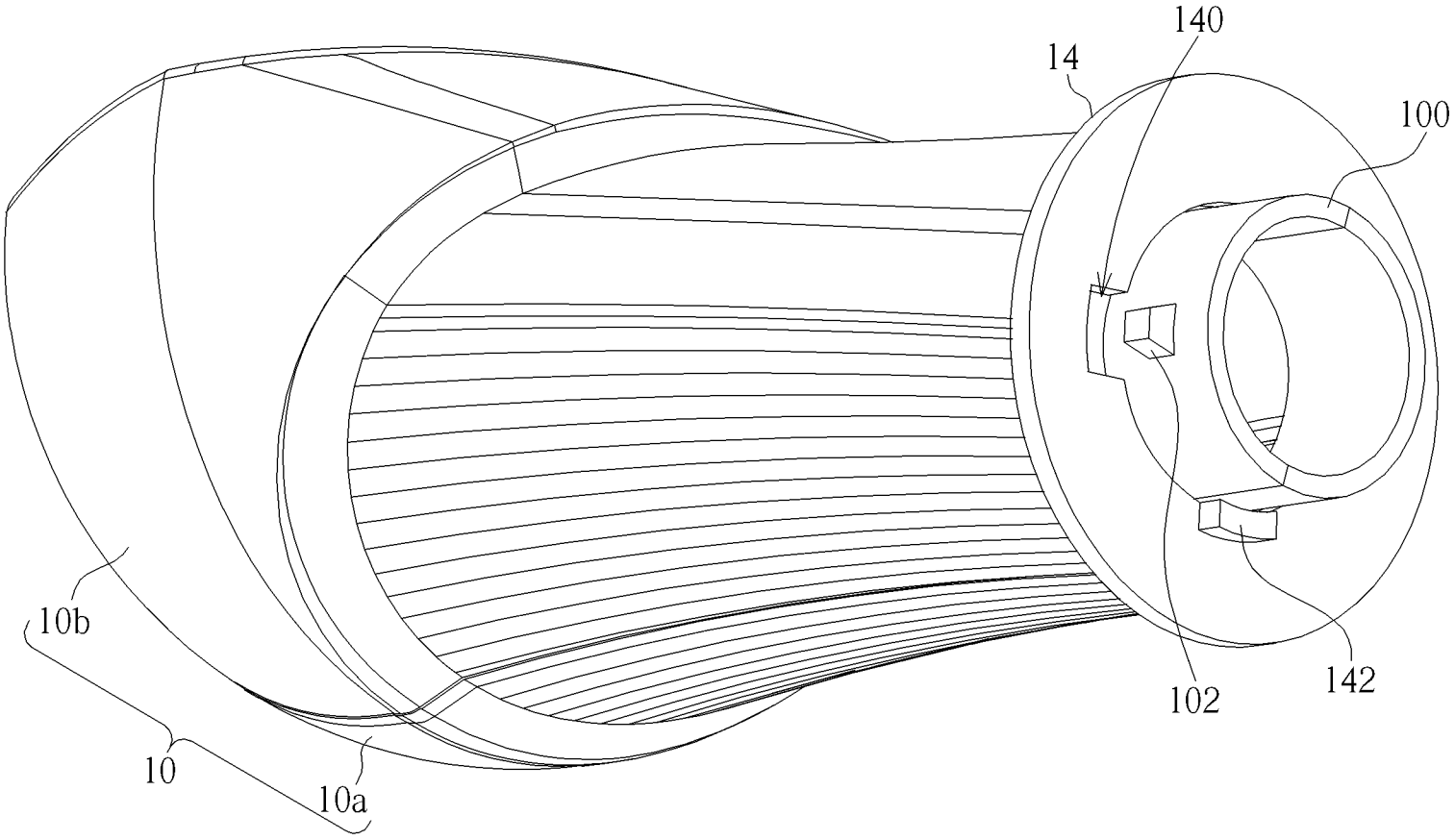
FIG. 4 is an assembly view illustrating the first protruding portion passing through the first indentation so as to dispose the first fixing member on the first rotating portion.
Figure 5:
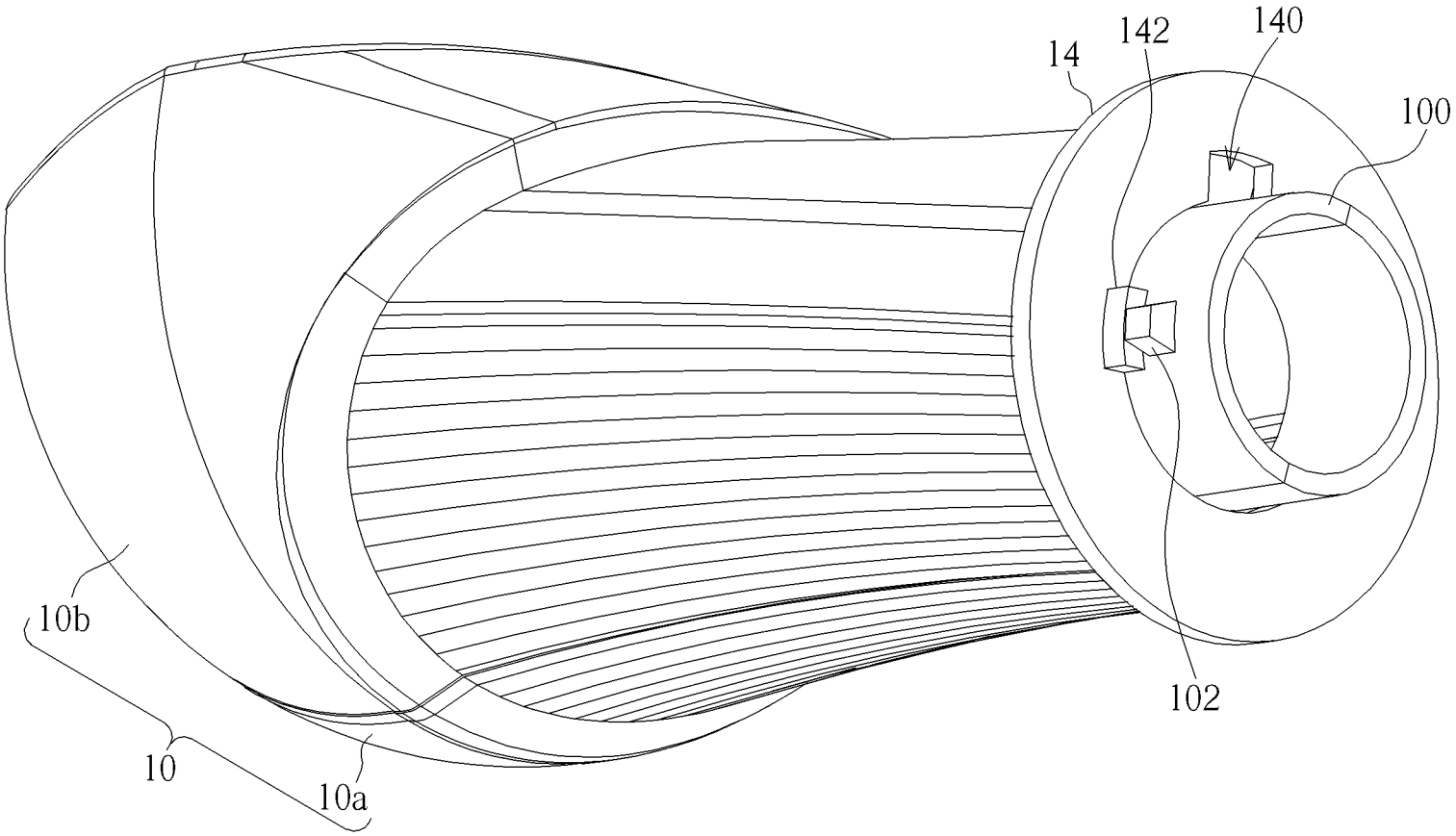
FIG. 5 is an assembly view illustrating the third protruding portion located below the first protruding portion after rotating the first fixing member.
Figure 6:
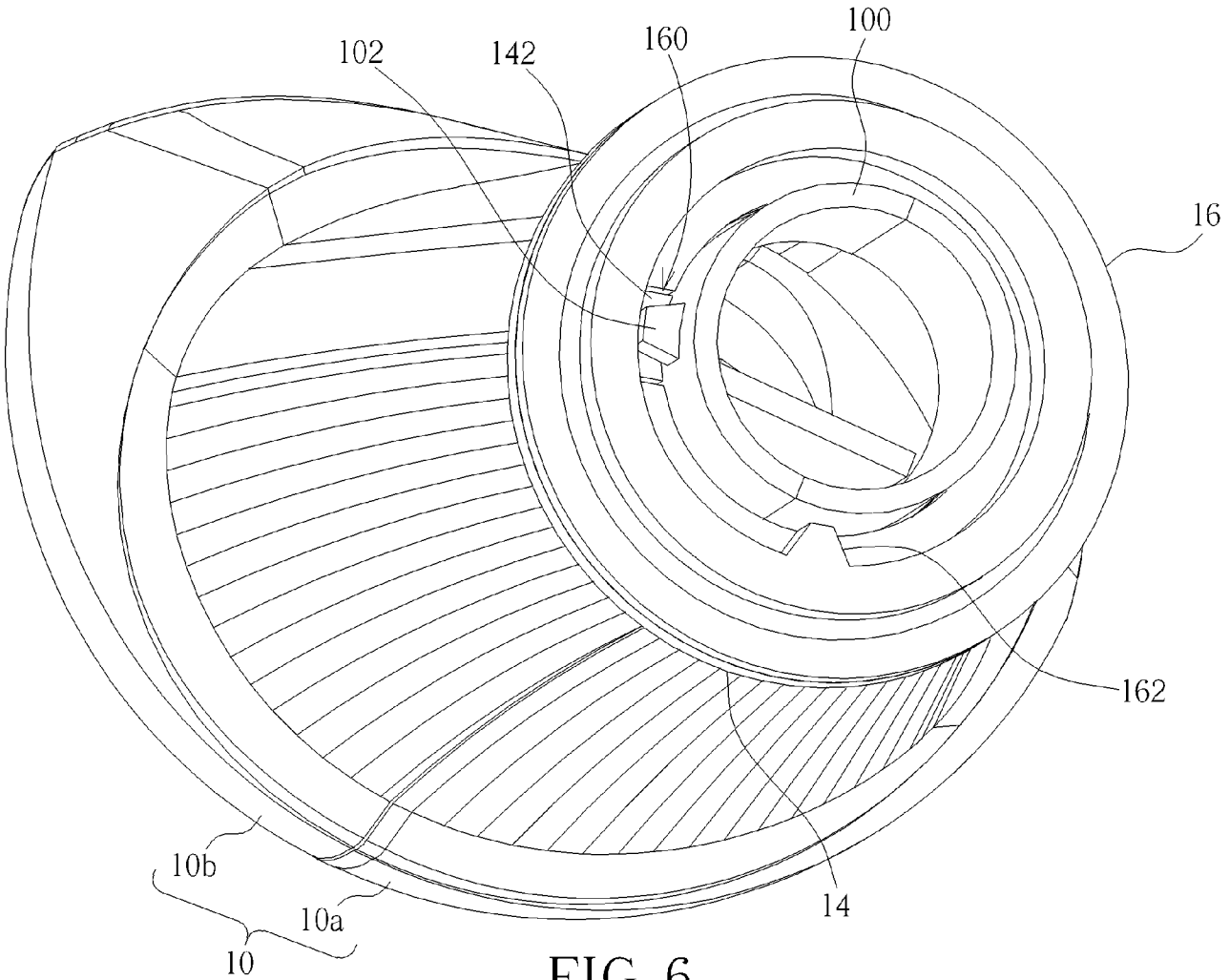
FIG. 6 is an assembly view illustrating the second fixing member disposed on the first rotating portion.
Figure 7:
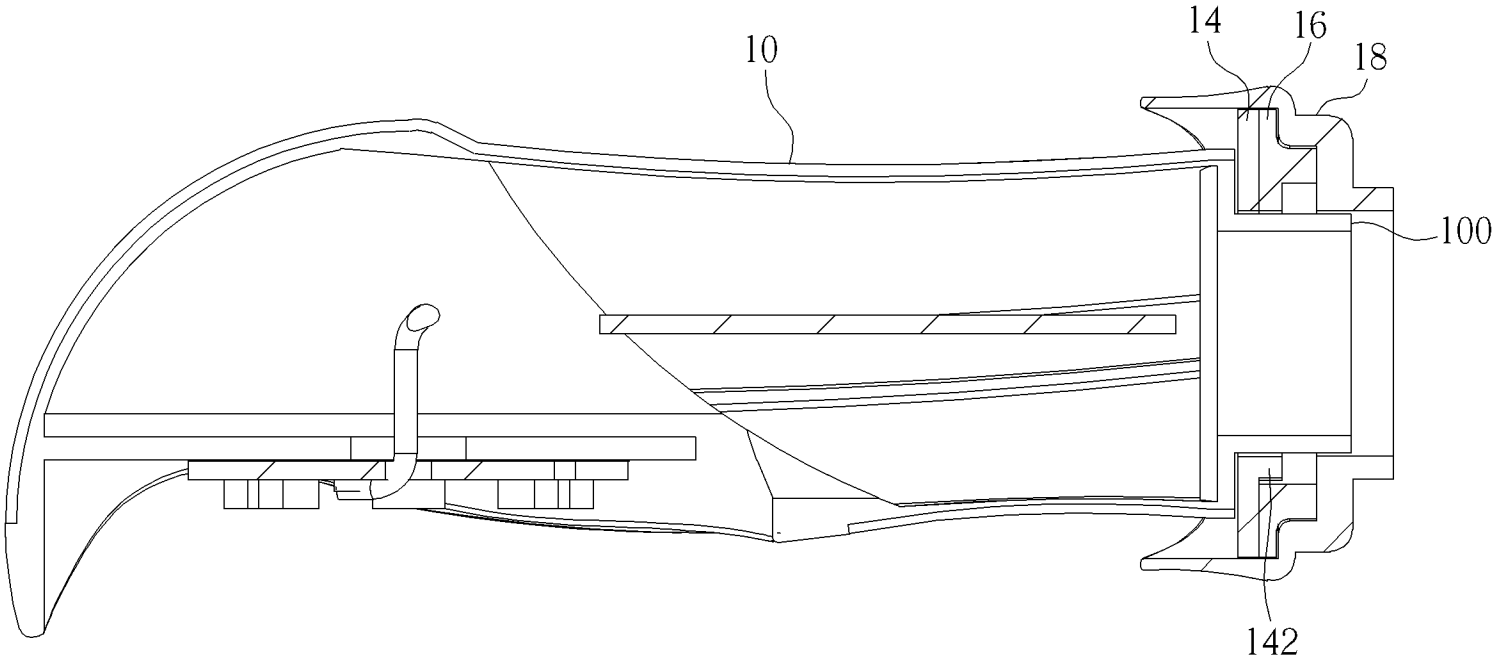
FIG. 7 is a cross-sectional view illustrating the cover disposed on the first fixing member and the second fixing member.

Referring to FIGS. 4 to 7, FIG. 4 is an assembly view illustrating the first protruding portion 102 passing through the first indentation 140 so as to dispose the first fixing member 14 on the first rotating portion 100, FIG. 5 is an assembly view illustrating the third protruding portion 142 located below the first protruding portion 102 after rotating the first fixing member 14, FIG. 6 is an assembly view illustrating the second fixing member 16 disposed on the first rotating portion 100, and FIG. 7 is a cross-sectional view illustrating the cover 18 disposed on the first fixing member 14 and the second fixing member 16.

To assemble the rotatable illumination device 1, the first casing 10, the light emitting module 12, the lamp lens 22 and the driving circuit board 24 can be assembled in the beginning. Afterward, the first protruding portion 102 of the first casing 10 passes through the first indentation 140 of the first fixing member 14 such that the first fixing member 14 is disposed on the first rotating portion 100, as shown in FIG. 4. After disposing the first fixing member 14 on the first rotating portion 100, the first fixing member 14 is rotated to locate the third protruding portion 142 below the first protruding portion 102. Afterward, the first protruding portion 102 of the first casing 10 and the third protruding portion 142 of the first fixing member 14 pass through the second indentation 160 of the second fixing member 16 such that the second fixing member 16 is disposed on the first rotating portion 100. At this time, as shown in FIG. 6, the third protruding portion 142 of the first fixing member 14 is located in the second indentation 160 of the second fixing member 16, and the first indentation 140 of the first fixing member 14 and the second indentation 160 of the second fixing member 16 are staggered with each other, so as to prevent the first fixing member 14 and the second fixing member 16 from falling off from the first rotating portion 100 while the first casing 10 is rotating with respect to the first fixing member 14 and the second fixing member 16. Afterward, the second fixing member 16 and the first fixing member 14 are fixed together by adhesive, tenon, or other conventional structures capable of fixing two elements together.

After disposing the first fixing member 14 and the second fixing member 16 on the first rotating portion 100 sequentially, the first protruding portion 102 of the first casing 10 and the second protruding portion 162 of the second fixing member 16 are coplanar. Therefore, when the first casing 10 rotates with respect to the first fixing member 14 and the second fixing member 16, the first protruding portion 102 of the first casing 10 can cooperate with the second protruding portion 162 of the second fixing member 16 to limit rotating angle of the first casing 10 so as to prevent the electric wires 26 disposed in the first casing 10 from getting damage due to over-rotation of the first casing 10.

Afterward, as shown in FIG. 7, the cover 18 is disposed on the first fixing member 14 and the second fixing member 16 and is fixed together with the first fixing member 14 and the second fixing member 16. Finally, the first lamp socket 20 is fixed on the cover 18 so as to finish assembling the rotatable illumination device 1. When the rotatable illumination device 1 is installed on a lamp holder (not shown) through the first lamp socket 20, the first casing 10 can rotate with respect to the first fixing member 14 and the second fixing member 16 so as to rotate the light emitting side of the light emitting module 12 to an appropriate light emitting angle. Since the first fixing member 14, the second fixing member 16, the cover 18 and the first lamp socket 20 are fixed together, the first fixing member 14, the second fixing member 16 and the cover 18 are immovable while the first casing 10 is rotating.

Figure 8:
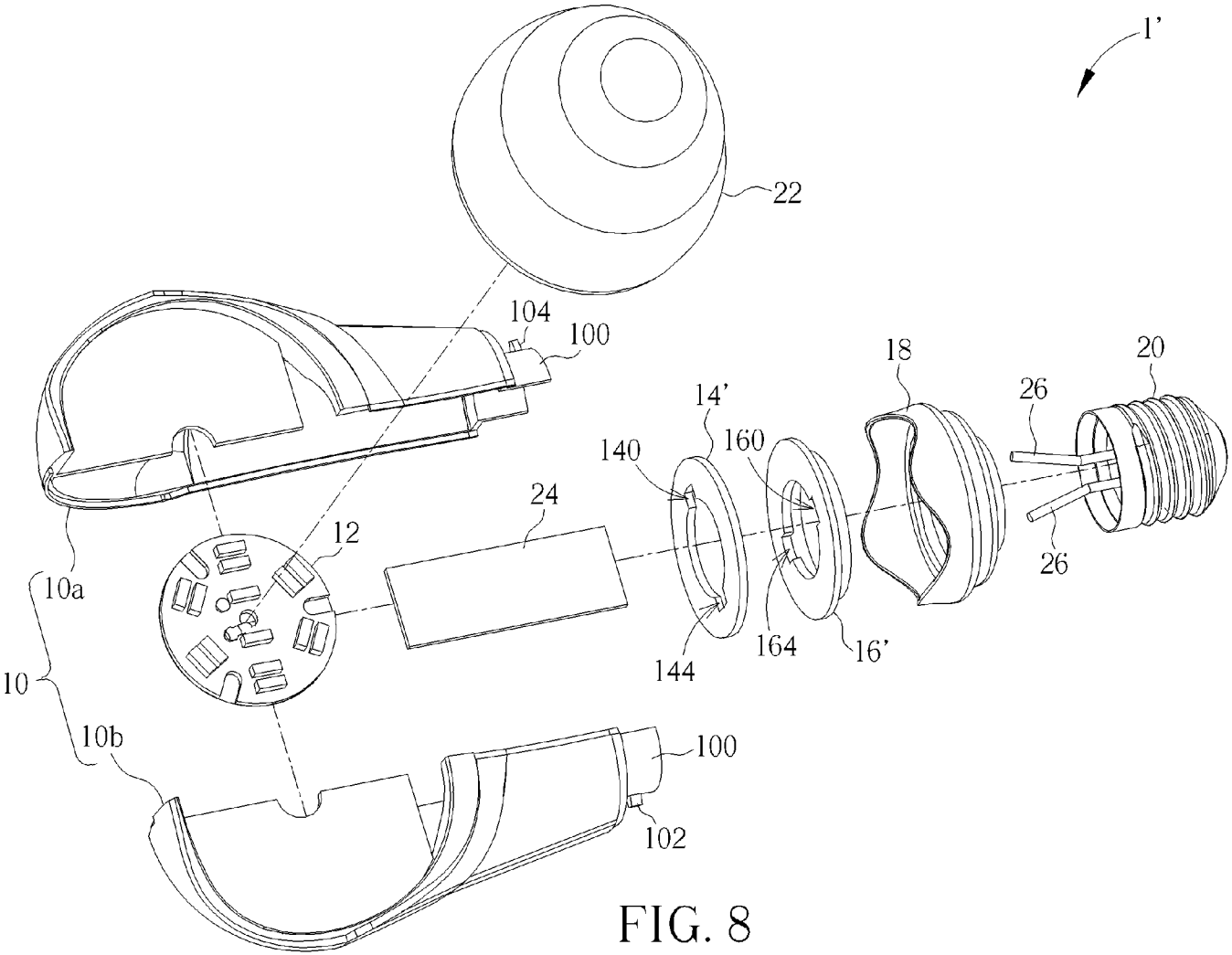
FIG. 8 is an exploded view illustrating a rotatable illumination device according to another embodiment of the invention.
Figure 9:
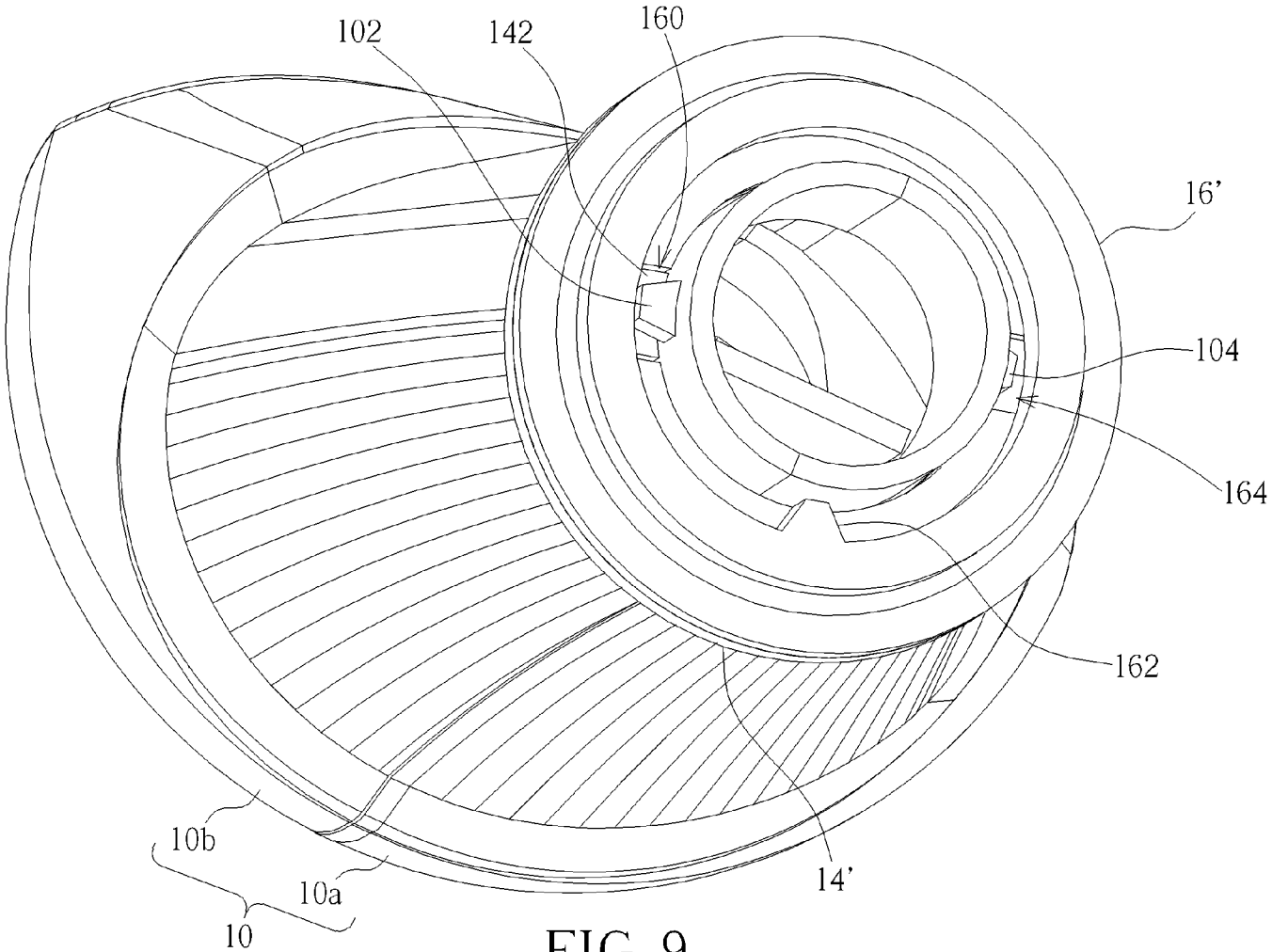
FIG. 9 is an assembly view illustrating the first fixing member and the second fixing member disposed on the first rotating portion shown in FIG. 8.

Referring to FIGS. 8 and 9, FIG. 8 is an exploded view illustrating a rotatable illumination device 1' according to another embodiment of the invention, and FIG. 9 is an assembly view illustrating the first fixing member 14' and the second fixing member 16' disposed on the first rotating portion 100 shown in FIG. 8. The main difference between the rotatable illumination device 1' and the aforesaid rotatable illumination device 1 is that a fourth protruding portion 104 is formed on the first rotating portion 100 of the rotatable illumination device 1', a third indentation 144 is formed on the first fixing member 14', and a fourth indentation 164 is formed on the second fixing member 16'. The first protruding portion 102 is capable of passing through the first indentation 140 and the second indentation 160 and the fourth protruding portion 104 is capable of passing through the third indentation 144 and the fourth indentation 164 (as shown in FIG. 8), such that the first fixing member 14' and the second fixing member 16' are capable of being disposed on the first rotating portion 100 sequentially. As shown in FIG. 9, after disposing the fixing member 14' and the second fixing member 16' on the first rotating portion 100 sequentially, the second protruding portion 162 of the second fixing member 16' is located between the first protruding portion 102 and the fourth protruding portion 104 so as to limit rotating angle of the first casing 10. In other words, the rotating angle of the first casing 10 can be determined by the configuration of the first protruding portion 102 and the fourth protruding portion 104. It should be noted that the same elements in FIGS. 8-9 and FIGS. 1-7 are represented by the same numerals, so the repeated explanation will not be depicted herein again.

Figure 10:
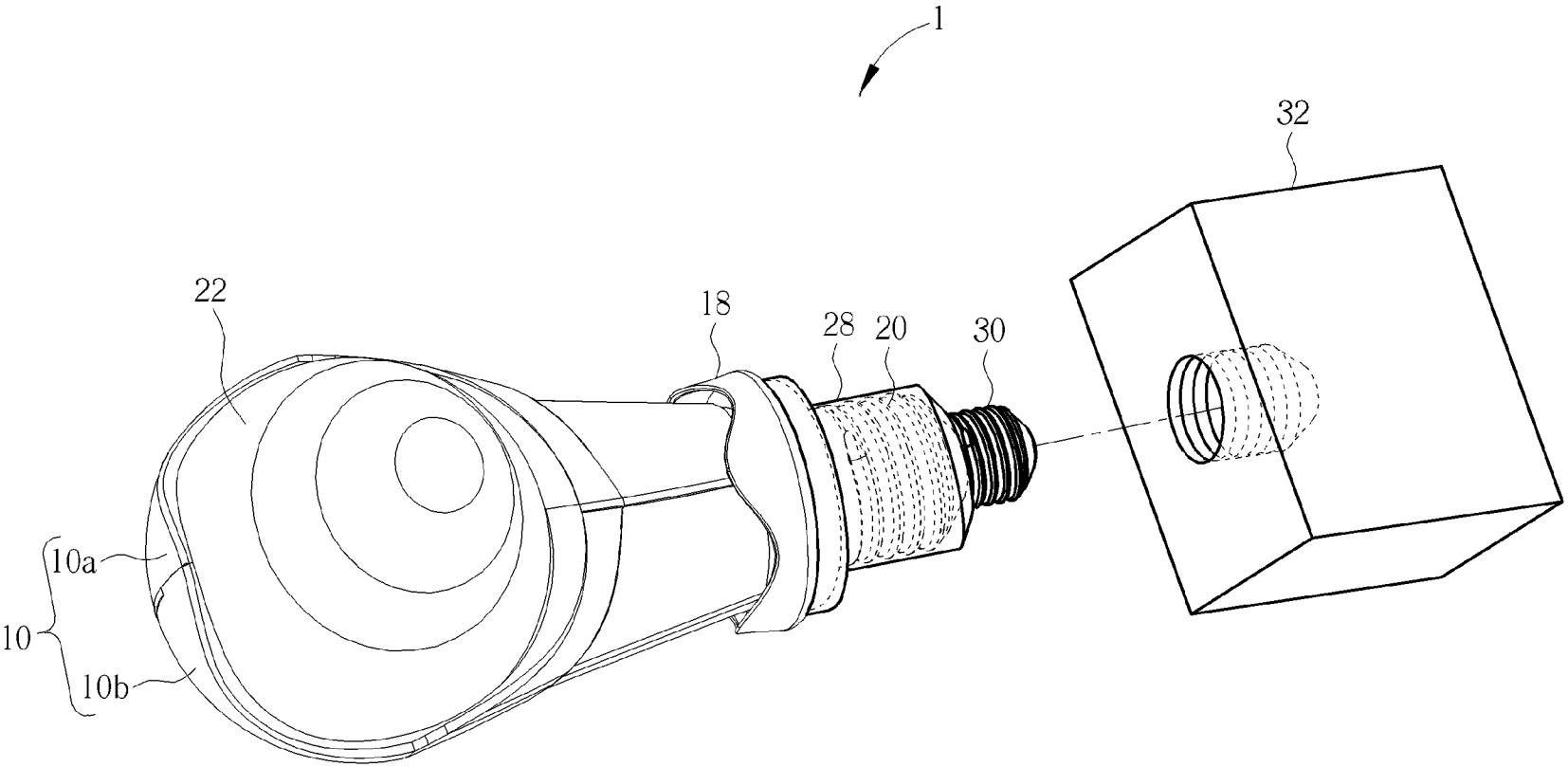
FIG. 10 is a schematic diagram illustrating an adapter with a second lamp socket being disposed on the first lamp socket and a lamp holder.

It should be noted that, referring to FIG. 10, the rotatable illumination devices 1 and 1' of the aforesaid embodiments may be used with an adapter 28, wherein the adapter 28 can be electrically connected to the first lamp socket 20. The adapter 28 comprises a second lamp socket 30 capable of being installed on a lamp holder 32. For example, if the first lamp socket 20 of this embodiment complies with E27 standard and the lamp holder 32 complies with E14 standard, the adapter 28, which complies with E27 to E14 standard, can be electrically connected to the first lamp socket 20 and then installed on the lamp holder 32 with the second lamp socket 30, which complies with E14 standard. Accordingly, the rotatable illumination device of the invention can be adapted for various lamp holders. Furthermore, the standard of the aforesaid adapter 28 is not limited to this embodiment and it should be determined based on the standards of the first lamp socket 20 and the lamp holder 32. Moreover, there are cross-type adapters, such as E27 to G9, E27 to B22, E27 to G5.3, E27 to MR-16, E27 to Gu10, etc., besides the same type adapter, such as E27 to E12, E27 to E17, E27 to E40, etc.

It should be noted that the light emitting module of the invention is not limited to the aforesaid embodiments. For example, the light emitting module of the invention may essentially consist of a light guide bar and a light emitting device (e.g. light emitting diode) in another embodiment depicted in the following.

Figure 11:
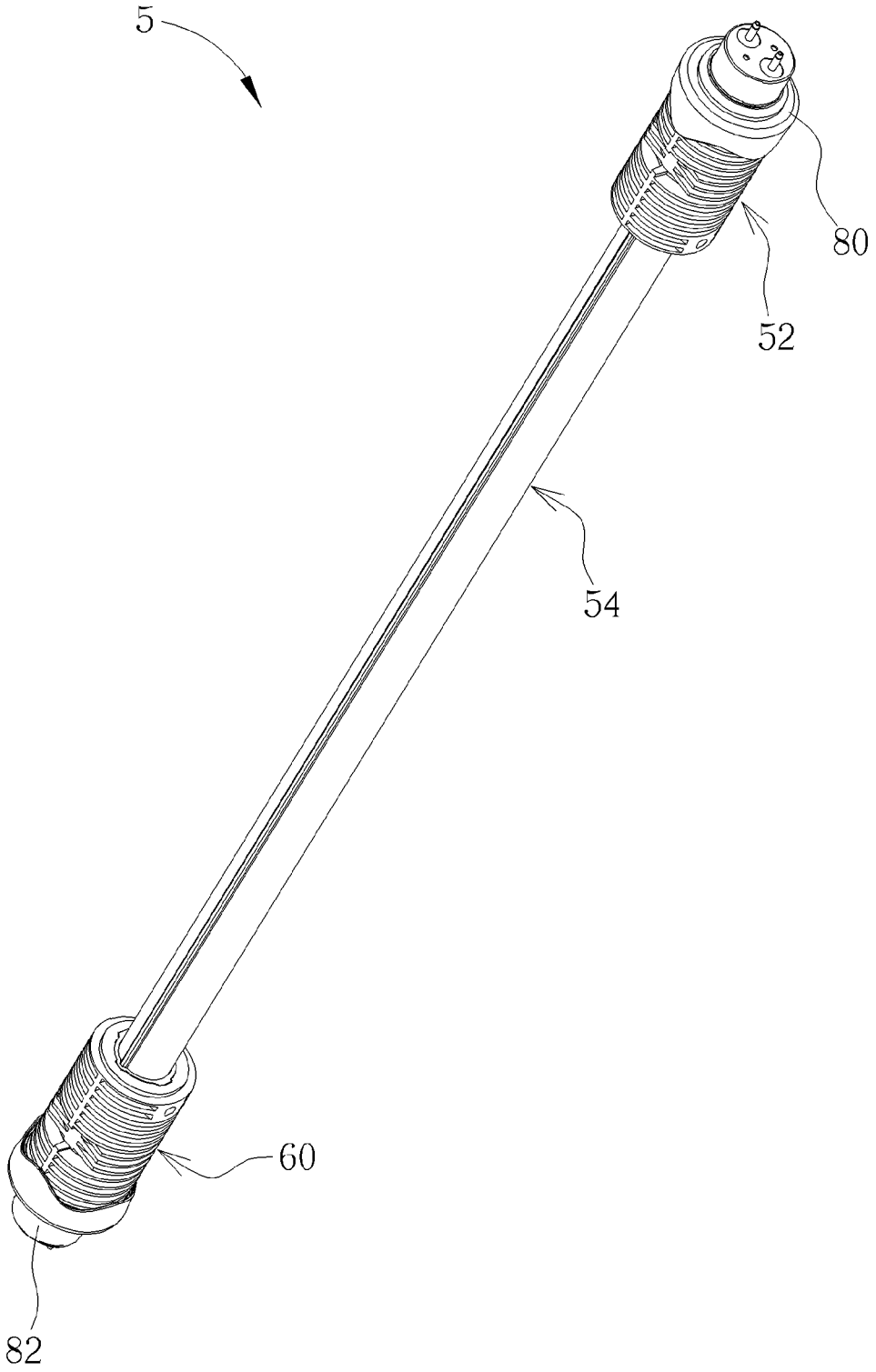
FIG. 11 is a perspective view illustrating a rotatable illumination device according to another embodiment of the invention.
Figure 12:
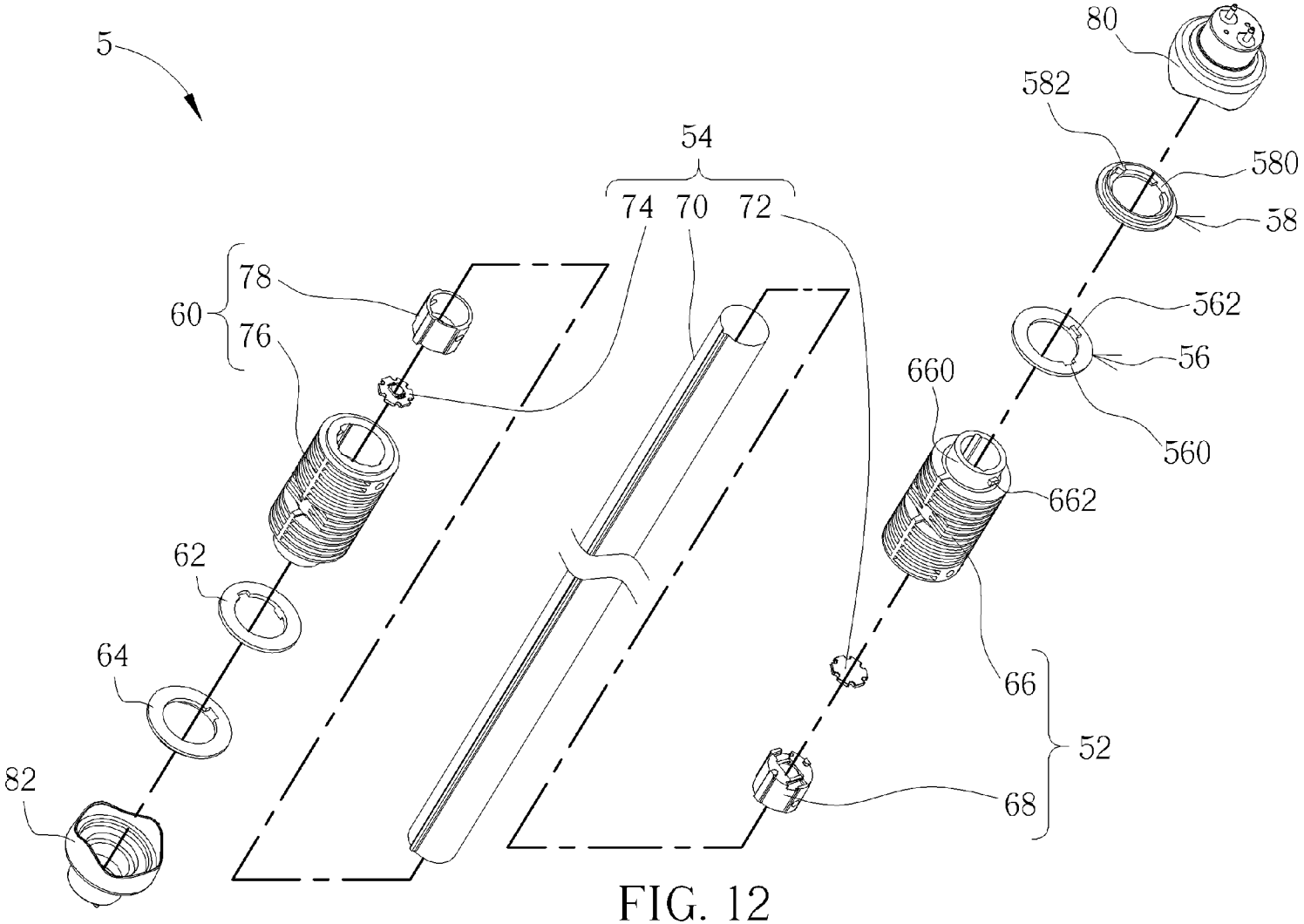
FIG. 12 is an exploded view illustrating the rotatable illumination device shown in FIG. 11.
Figure 13:
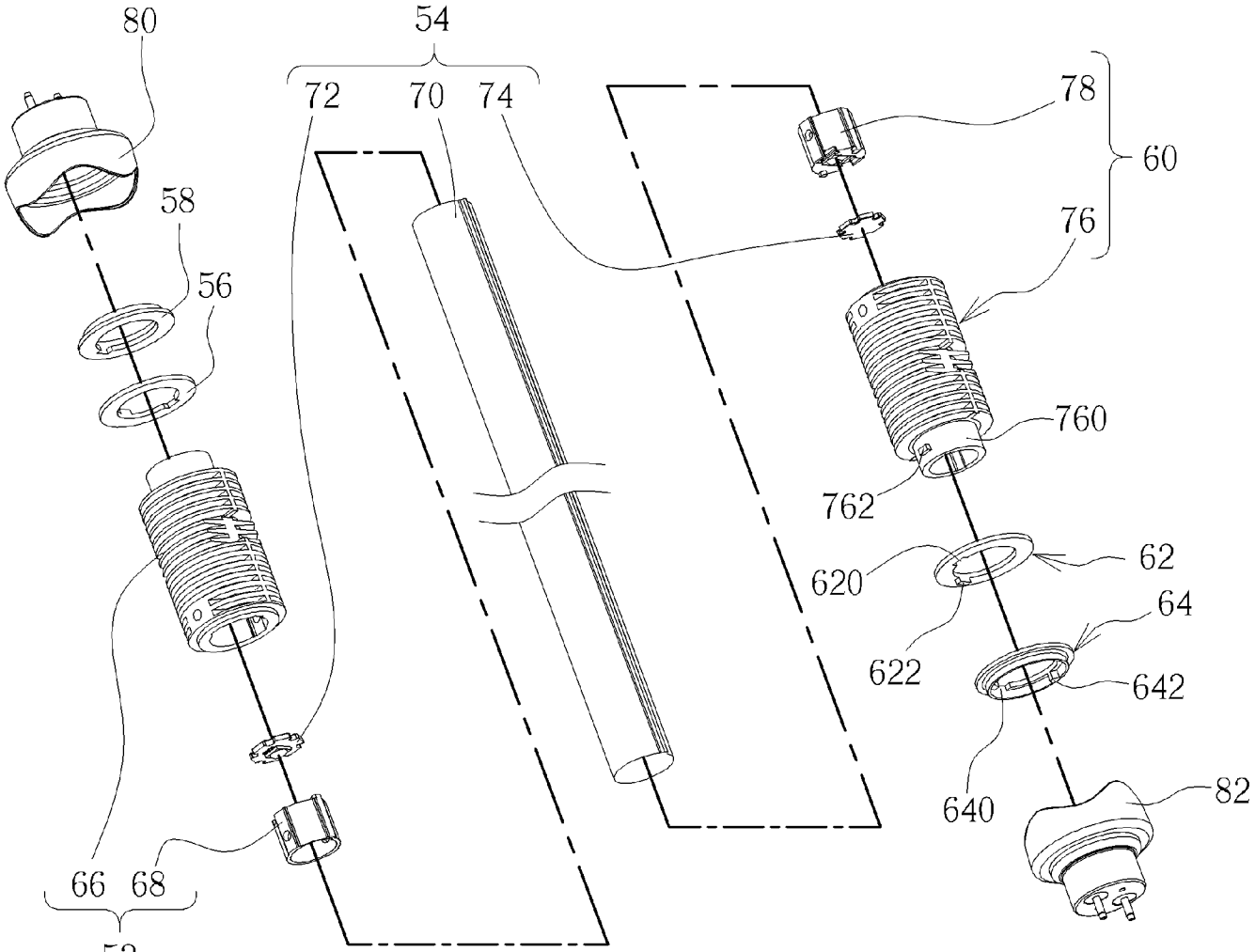
FIG. 13 is an exploded view illustrating the rotatable illumination device shown in FIG. 11 from another viewing angle.

Referring to FIGS. 11 to 13, FIG. 11 is a perspective view illustrating a rotatable illumination device 5 according to another embodiment of the invention, FIG. 12 is an exploded view illustrating the rotatable illumination device 5 shown in FIG. 11, and FIG. 13 is an exploded view illustrating the rotatable illumination device 5 shown in FIG. 11 from another viewing angle. As shown in FIGS. 11 to 13, the rotatable illumination device 5 comprises a first casing 52, a light emitting module 54, a first fixing member 56, a second fixing member 58, a second casing 60, a third fixing member 62 and a fourth fixing member 64. In this embodiment, the first casing 52 may comprise a heat dissipating sleeve 66 and a fixing sleeve 68, the heat dissipating sleeve 66 has a first rotating portion 660, and a first protruding portion 662 is formed on the first rotating portion 660. The light emitting module 54 is disposed in the first and second casings 52, 60. In this embodiment, the light emitting module 54 may comprise a light guide bar 70 and a light emitting device 72. One end of the light guide bar 70 is fixed in the fixing sleeve 68 and the fixing sleeve 68 is fixed in the heat dissipating sleeve 66. The light emitting device 72 may be a light emitting diode (LED) preferably. The light emitting device 72 is disposed between the heat dissipating sleeve 66 and the fixing sleeve 68 and used for emitting light to the light guide bar 70. Accordingly, the light emitting module 54 can utilize the light guide bar 70 to guide light so as to generate uniform illumination.

A first indentation 560 and a third protruding portion 562 are formed on the first fixing member 56 and the third protruding portion 562 is corresponding to the first protruding portion 662. The first protruding portion 662 is capable of passing through the first indentation 560 such that the first fixing member 56 is capable of being disposed on the first rotating portion 660. A second indentation 580 and a second protruding portion 582 are formed on the second fixing member 58. The first protruding portion 662 and the third protruding portion 562 are capable of passing through the second indentation 580 such that the second fixing member 58 is capable of being disposed on the first rotating portion 660.

As shown in FIG. 13, in this embodiment, the light emitting module 54 may further comprise a light emitting device 74. The second casing 60 may comprise a heat dissipating sleeve 76 and a fixing sleeve 78. The heat dissipating sleeve 76 has a second rotating portion 760 and a fourth protruding portion 762 is formed on the second protruding portion 760. Another end of the light guide bar 70 is fixed in the fixing sleeve 78 and the fixing sleeve 78 is fixed in the heat dissipating sleeve 76. The light emitting device 74 may be an LED preferably. The light emitting device 74 is disposed between the heat dissipating sleeve 76 and the fixing sleeve 78 and used for emitting light to the light guide bar 70. A third indentation 620 and a sixth protruding portion 622 are formed on the third fixing member 62 and the sixth protruding portion 622 is corresponding to the fourth protruding portion 762. The fourth protruding portion 762 is capable of passing through the third indentation 620 such that the third fixing member 62 is capable of being disposed on the second rotating portion 760. A fourth indentation 640 and a fifth protruding portion 642 are formed on the fourth fixing member 64. The fourth protruding portion 762 and the sixth protruding portion 622 are capable of passing through the fourth indentation 640 such that the fourth fixing member 64 is capable of being disposed on the second rotating portion 760.

Furthermore, the rotatable illumination device 5 may further comprise a first lamp plug 80 and a second lamp plug 82. The first lamp plug 80 is disposed on and fixed with the first fixing member 56 and the second fixing member 58. The second lamp plug 82 is disposed on and fixed with the third fixing member 62 and the fourth fixing member 64. Accordingly, the first lamp plug 80 and the second lamp plug 82 of the rotatable illumination device 5 can be inserted into and electrically connected to a lamp holder such that the rotatable illumination device 5 can be used as illumination equipment, such as stand light.

Figure 14:
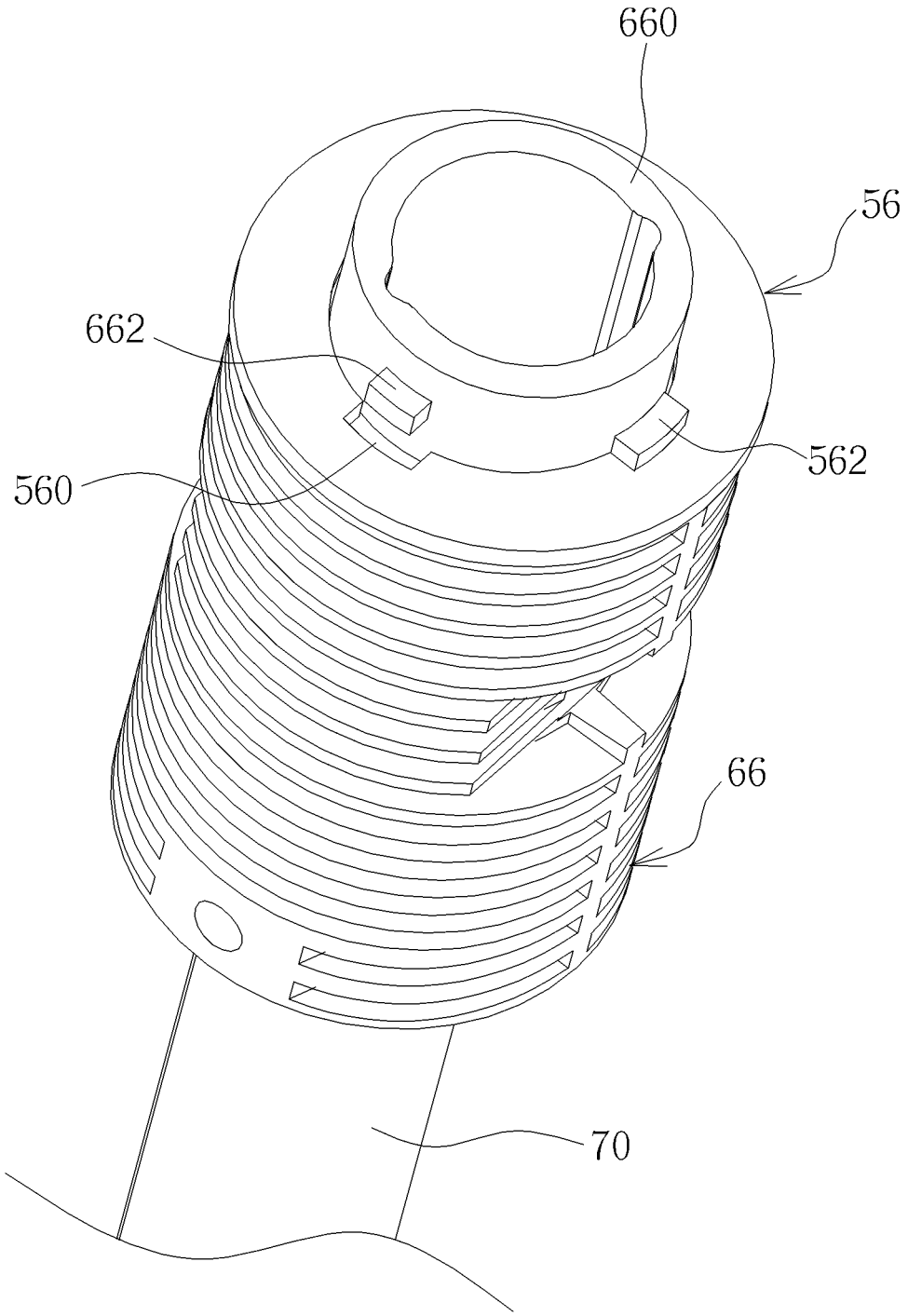
FIG. 14 is an assembly view illustrating the first protruding portion passing through the first indentation so as to dispose the first fixing member on the first rotating portion.
Figure 15:
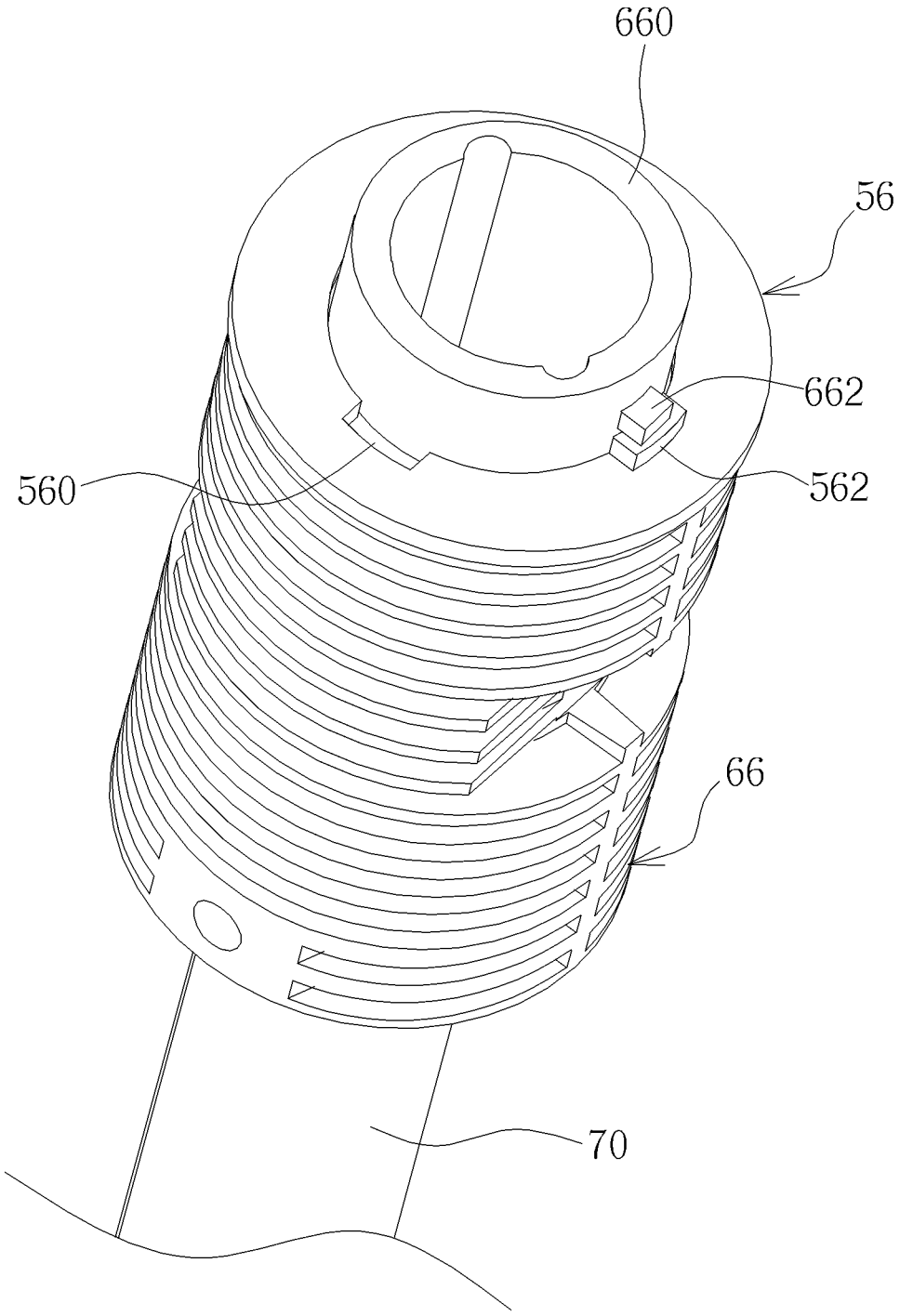
FIG. 15 is an assembly view illustrating the third protruding portion located below the first protruding portion after rotating the first fixing member.
Figure 16:
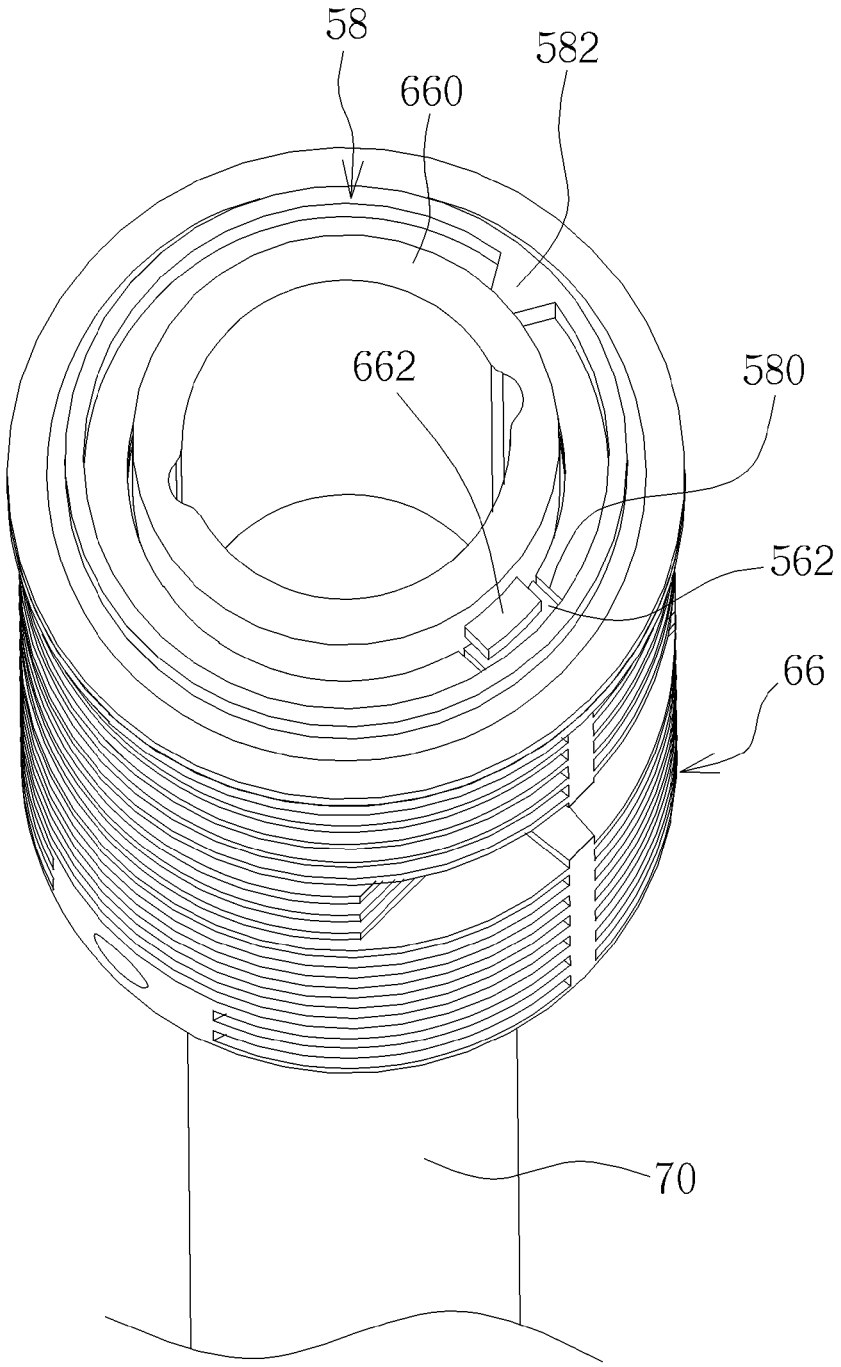
FIG. 16 is an assembly view illustrating the second fixing member disposed on the first fixing member such that the first protruding portion and the second protruding portion are coplanar.

Referring to FIGS. 14 to 16, FIG. 14 is an assembly view illustrating the first protruding portion 662 passing through the first indentation 560 so as to dispose the first fixing member 56 on the first rotating portion 660, FIG. 15 is an assembly view illustrating the third protruding portion 562 located below the first protruding portion 662 after rotating the first fixing member 56, and FIG. 16 is an assembly view illustrating the second fixing member 58 disposed on the first fixing member 56 such that the first protruding portion 662 and the second protruding portion 582 are coplanar.

To assemble the rotatable illumination device 5, the light guide bar 70, the fixing sleeve 68, the light emitting device 72 and the heat dissipating sleeve 66 can be assembled in the beginning. Afterward, the first protruding portion 662 of the heat dissipating sleeve 66 passes through the first indentation 560 of the first fixing member 56 such that the first fixing member 56 is disposed on the first rotating portion 660, as shown in FIG. 14. After disposing the first fixing member 56 on the first rotating portion 660, the first fixing member 56 is rotated to locate the third protruding portion 562 below the first protruding portion 662. Afterward, the first protruding portion 662 of the heat dissipating sleeve 66 and the third protruding portion 562 of the first fixing member 56 pass through the second indentation 580 of the second fixing member 58 such that the second fixing member 58 is disposed on the first rotating portion 660. At this time, as shown in FIG. 16, the third protruding portion 562 of the first fixing member 56 is located in the second indentation 580 of the second fixing member 58, and the first indentation 560 of the first fixing member 56 and the second indentation 580 of the second fixing member 58 are staggered with each other, so as to prevent the first fixing member 56 and the second fixing member 58 from falling off from the first rotating portion 660 while the heat dissipating sleeve 66 is rotating with respect to the first fixing member 56 and the second fixing member 58. Afterward, the second fixing member 58 and the first fixing member 56 are fixed together by adhesive, tenon, or other conventional structures capable of fixing two elements together.

After disposing the first fixing member 56 and the second fixing member 58 on the first rotating portion 660 sequentially, the first protruding portion 662 of the heat dissipating sleeve 66 and the second protruding portion 582 of the second fixing member 58 are coplanar. Therefore, when the heat dissipating sleeve 66 rotates with respect to the first fixing member 56 and the second fixing member 58, the first protruding portion 662 of the heat dissipating sleeve 66 can cooperate with the second protruding portion 582 of the second fixing member 58 to limit rotating angle of the heat dissipating sleeve 66 so as to prevent electric wires disposed in the heat dissipating sleeve 66 from getting damage due to over-rotation of the heat dissipating sleeve 66.

Finally, the first lamp plug 80 is disposed on and fixed with the first fixing member 56 and the second fixing member 58 so as to finish assembling the first casing 52 with the light guide bar 70, the first fixing member 56, the second fixing member 58 and the first lamp plug 80. According to the aforesaid configuration, when the first lamp plug 80 of the rotatable illumination device 5 is installed on a lamp holder (not shown), the heat dissipating sleeve 66 can rotate with respect to the first fixing member 56 and the second fixing member 58 so as to rotate the light emitting side of the light guide bar 70 of the light emitting module 54 to an appropriate light emitting angle. Since the first fixing member 56, the second fixing member 58 and the first lamp plug 80 are fixed together, the first fixing member 56, the second fixing member 58 and the first lamp plug 80 are immovable while the heat dissipating sleeve 66 is rotating.

As to the operation of assembling the second casing 60 with the light guide bar 70, the third fixing member 62, the fourth fixing member 64 and the second lamp plug 82, it can be implemented through the same manner mentioned in the above. That is to say, the fourth protruding portion 762 of the heat dissipating sleeve 76 passes through the third indentation 620 of the third fixing member 62 such that the third fixing member 62 is disposed on the second rotating portion 760. Afterward, the fourth protruding portion 762 of the heat dissipating sleeve 76 and the sixth protruding portion 622 of the third fixing member 62 pass through the fourth indentation 640 of the fourth fixing member 64 such that the fourth fixing member 64 is disposed on the second rotating portion 760. Afterward, the fourth fixing member 64 and the third fixing member 62 are fixed together by adhesive, tenon, or other conventional structures capable of fixing two elements together.

After disposing the third fixing member 62 and the fourth fixing member 64 on the second rotating portion 760 sequentially, the fourth protruding portion 762 of the heat dissipating sleeve 76 and the fifth protruding portion 642 of the fourth fixing member 64 are coplanar. Therefore, when the heat dissipating sleeve 76 rotates with respect to the third fixing member 62 and the fourth fixing member 64, the fourth protruding portion 762 of the heat dissipating sleeve 76 can cooperate with the fifth protruding portion 642 of the fourth fixing member 64 to limit rotating angle of the heat dissipating sleeve 76 so as to prevent electric wires disposed in the heat dissipating sleeve 76 from getting damage due to over-rotation of the heat dissipating sleeve 76.

Finally, the second lamp plug 82 is disposed on and fixed with the third fixing member 62 and the fourth fixing member 64 so as to finish assembling the second casing 60 with the light guide bar 70, the third fixing member 62, the fourth fixing member 64 and the second lamp plug 82. According to the aforesaid configuration, when the second lamp plug 82 of the rotatable illumination device 5 is installed on a lamp holder (not shown), the heat dissipating sleeve 76 can rotate with respect to the third fixing member 62 and the fourth fixing member 64. Since the third fixing member 62, the fourth fixing member 64 and the second lamp plug 82 are fixed together, the third fixing member 62, the fourth fixing member 64 and the second lamp plug 82 are immovable while the heat dissipating sleeve 76 is rotating.

It should be noted that the light emitting module 54 is not limited to the aforesaid embodiment and can utilize the light guide bar to guide light in other manners. For example, the light emitting device may be embedded in the light guide bar directly and this manner is well known by one skilled in the art, so it will not be depicted herein. Furthermore, the structures of the first casing 52 and the second casing 60 can be designed in various manners according to the illumination type of the light emitting module 54. For example, instead of the aforesaid combination of heat dissipating sleeve and fixing sleeve, the first casing 12 and the second casing 20 may be single fixing sleeves fixed on opposite ends of the light guide bar 30, the light emitting device 32 may be disposed in one end of the light guide bar 30, which is fixed in the first casing 12, and the light emitting device 34 may be disposed in the other end of the light guide bar 30, which is fixed in the second casing 20; or alternatively, the first casing 12 and the second casing 20 may be single heat dissipating sleeves fixed on opposite ends of the light guide bar 30, the light emitting device 32 may be disposed in one end of the light guide bar 30, which is fixed in the first casing 12, and the light emitting device 34 may be disposed in the other end of the light guide bar 30, which is fixed in the second casing 20. Still further, the invention may dispose only one casing, which can rotate with respect to the fixing member, on one end of the light guide bar, so as to simplify configuration and related circuit design of the rotatable illumination device 1.

As mentioned in the above, when the rotatable illumination device is installed on a lamp holder through the first lamp socket, the first casing can rotate with respect to the first and second fixing members so as to rotate the light emitting side of the light emitting module to an appropriate light emitting angle. Furthermore, when the first casing rotates with respect to the first and second fixing members, the first protruding portion can cooperate with the second protruding portion to limit rotating angle of the first casing so as to prevent electric wires disposed in the first casing from getting damage due to over-rotation of the first casing. Moreover, two protruding portions may be disposed on the first rotating portion so as to limit rotating angle of the first casing. Still further, the rotatable illumination device of the invention may be used with an adapter so as to be adapted for various lamp holders.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A rotatable illumination device comprising:

a first casing having a first rotating portion, a first protruding portion being formed on the first rotating portion;

a light emitting module disposed in the first casing;

a first fixing member, a first indentation being formed on the first fixing member, the first protruding portion being capable of passing through the first indentation such that the first fixing member is capable of being disposed on the first rotating portion; and a second fixing member, a second indentation and a second protruding portion being formed on the second fixing member, the first protruding portion being capable of passing through the second indentation such that the second fixing member is capable of being disposed on the first rotating portion;

wherein after disposing the first and second fixing members on the first rotating portion sequentially, the first and second fixing members are fixed together, and the first and second protruding portions are coplanar; when the first casing rotates with respect to the first and second fixing members, the first protruding portion cooperates with the second protruding portion to limit rotating angle of the first casing.

2. The rotatable illumination device of claim 1, wherein a third protruding portion is formed on the first fixing member and corresponding to the first protruding portion, after disposing the first and second fixing members on the first rotating portion sequentially, the third protruding portion is located in the second indentation.

3. The rotatable illumination device of claim 1, wherein a fourth protruding portion is formed on the first rotating portion, a third indentation is formed on the first fixing member, a fourth indentation is formed on the second fixing member, the fourth protruding portion is capable of passing through the third and fourth indentations such that the first and second fixing members are capable of being disposed on the first rotating portion sequentially, after disposing the first and second fixing members on the first rotating portion sequentially, the second protruding portion is located between the first and fourth protruding portions so as to limit rotating angle of the first casing.

4. The rotatable illumination device of claim 1, further comprising a cover disposed on the first and second fixing members and fixed together with the first and second fixing members.

5. The rotatable illumination device of claim 4, further comprising a first lamp socket fixed on the cover.

6. The rotatable illumination device of claim 4, further comprising an adapter electrically connected to the first lamp socket, the adapter comprising a second lamp socket capable of being installed on a lamp holder.

7. The rotatable illumination device of claim 1, wherein the first casing essentially consists of two half first casings.

8. The rotatable illumination device of claim 1, further comprising a first lamp plug disposed on and fixed with the first and second fixing members.

9. The rotatable illumination device of claim 1, wherein the first casing comprises a heat dissipating sleeve and a fixing sleeve, the heat dissipating sleeve has the first rotating portion, the fixing sleeve is fixed in the heat dissipating sleeve, the light emitting module comprises:

a light guide bar, one end of the light guide bar being fixed in the fixing sleeve; and a light emitting device disposed between the heat dissipating sleeve and the fixing sleeve and used for emitting light to the light guide bar.

10. The rotatable illumination device of claim 9, wherein the light emitting device is a light emitting diode.

11. The rotatable illumination device of claim 1, wherein the first casing is a fixing sleeve, the light emitting module comprises:

a light guide bar, one end of the light guide bar being fixed in the fixing sleeve; and a light emitting device disposed in the end of the light guide bar, which is fixed in the fixing sleeve, and used for emitting light to the light guide bar.

12. The rotatable illumination device of claim 1, wherein the first casing is a heat dissipating sleeve, the light emitting module comprises:

a light guide bar, one end of the light guide bar being fixed in the heat dissipating sleeve; and a light emitting device disposed in the end of the light guide bar, which is fixed in the heat dissipating sleeve, and used for emitting light to the light guide bar.

13. The rotatable illumination device of claim 1, further comprising:

a second casing having a second rotating portion, a fourth protruding portion being formed on the second rotating portion;

a third fixing member, a third indentation being formed on the third fixing member, the fourth protruding portion being capable of passing through the third indentation such that the third fixing member is capable of being disposed on the second rotating portion; and a fourth fixing member, a fourth indentation and a fifth protruding portion being formed on the fourth fixing member, the fourth protruding portion being capable of passing through the fourth indentation such that the fourth fixing member is capable of being disposed on the second rotating portion;

wherein after disposing the third and fourth fixing members on the second rotating portion sequentially, the third and fourth fixing members are fixed together, and the fourth and fifth protruding portions are coplanar; when the second casing and the light emitting module rotate with respect to the third and fourth fixing members, the fourth protruding portion cooperates with the fifth protruding portion to limit rotating angle of the second casing and the light emitting module.

14. The rotatable illumination device of claim 13, wherein a sixth protruding portion is formed on the second fixing member and corresponding to the fourth protruding portion, after disposing the third and fourth fixing members on the second rotating portion sequentially, the sixth protruding portion is located in the fourth indentation.

15. The rotatable illumination device of claim 13, wherein the second casing comprises a heat dissipating sleeve and a fixing sleeve, the heat dissipating sleeve has the second rotating portion, the fixing sleeve is fixed in the heat dissipating sleeve, the light emitting module comprises:

a light guide bar, one end of the light guide bar being fixed in the fixing sleeve; and a light emitting device disposed between the heat dissipating sleeve and the fixing sleeve and used for emitting light to the light guide bar.

16. The rotatable illumination device of claim 13, further comprising a second lamp plug disposed on and fixed with the third and fourth fixing members.

17. The rotatable illumination device of claim 13, wherein each of the first and second casings is a fixing sleeve, the light emitting module comprises:

a light guide bar, opposite ends of the light guide bar being fixed in the first and second casings, respectively; and a light emitting device disposed in the opposite ends of the light guide bar, which are fixed in the first and second casings, and used for emitting light to the light guide bar.

* * * * *

UNITED STATES PATENT AND TRADEMARK OFFICE

CERTIFICATE OF CORRECTION

PATENT NO. : 8,777,464 B2
APPLICATION NO. : 13/655423
DATED : July 15, 2014
INVENTOR(S) : Chien-Ku Lin et al.

It is certified that error appears in the above-identified patent and that said Letters Patent is hereby corrected as shown below:

On the title page, item (71), add --WINTEK CORPORATION, Taichung City (TW)-- as the second applicant.

Signed and Sealed this
Seventh Day of October, 2014

Michelle K. Lee

Michelle K. Lee
*Deputy Director of the United States Patent and Trademark Office*